US005732048A

United States Patent [19]

Klingenberg

[11] Patent Number: 5,732,048

[45] Date of Patent: Mar. 24, 1998

[54] WATCHCASE

[75] Inventor: Hans U. Klingenberg, Merzligen, Switzerland

[73] Assignee: Vacuum Chronometer Corporation, Viadukstrasse, Switzerland

[21] Appl. No.: 718,520

[22] PCT Filed: Apr. 21, 1995

[86] PCT No.: PCT/CH95/00086

§ 371 Date: Oct. 8, 1996

§ 102(e) Date: Oct. 8, 1996

[87] PCT Pub. No.: WO95/29431

PCT Pub. Date: Nov. 2, 1995

[30] Foreign Application Priority Data

Apr. 22, 1994 [CH] Switzerland ..... 1263/94

[51] Int. Cl.[6] ..... G04B 37/00; A44C 5/14

[52] U.S. Cl. ..... 368/282; 224/167

[58] Field of Search ..... 368/281–282; 224/164, 177, 167

[56] References Cited

U.S. PATENT DOCUMENTS 4,903,253 2/1990 Nikles et al. ..... 368/282

FOREIGN PATENT DOCUMENTS

A-0-400-206 5/1990 European Pat. Off. .
1-834-477 7/1961 Germany .
199531 8/1938 Switzerland ..... 348/282
A-368-427 5/1963 Switzerland .
A-685-035 3/1995 Switzerland .

*Primary Examiner*—Vit W. Miska
*Attorney, Agent, or Firm*—Oliff & Berridge P.L.C.

[57] ABSTRACT

In the **6*h*–12*h* axis of the watchcase (1), two vertical bores (9) are made in the middle (2) of the watchcase. Inserted in these bores is one metal cylinder (10) each with a horizontal bore (12) and a vertical bore (14). Screwed into the horizontal bore (12), which has been provided with a threading (11), is a screw (23), which fastens the band connection (21) to the side (33) of the middle (2). Screwed into the vertical bore (14), which has been provided with an internal threading (13), is a screw (18) which fastens the back cover (3) of the watchcase to the middle (2). In the side (33) at 6*h* and 12*h* one horizontal or vertical ground area (22) each is foreseen in which the band connections (21) are somewhat recessed. Achieved through this configuration is that the band connections (21**) for fastening the watchband have no play and do not turn.

6 Claims, 1 Drawing Sheet

WATCHCASE

This invention relates to a watchcase with a middle, a back cover and a crystal.

In CH-A-685 035 a watchcase is described in which fastening pins, provided with fastening rings, are inserted in lateral bores for the wristlet. These fastening pins are secured by retention screws reaching through them. This configuration has the drawback that the ring, connected to the fastening pin, serving as the band connection, has play and can turn somewhat. It is therefore the object of the present invention to create a watchcase which does not have the aforementioned drawbacks, but one where instead the band connection for the wristlet is secured against turning. This object is attained, according to the invention, by means of two metal cylinders inserted in bores in the middle, with at least one horizontal and vertical bore each, provided with a threading, for accepting horizontal and vertical fastening screws, the horizontal fastening screws being led in horizontal bores in the middle and serving to fasten a band connection to the watchcase, and the screw heads of the horizontal fastening screws abutting the band connection on the inside, and means for rotation-tight holding of the band connection.

Preferred embodiments result from the dependent claims.

Figure 1:
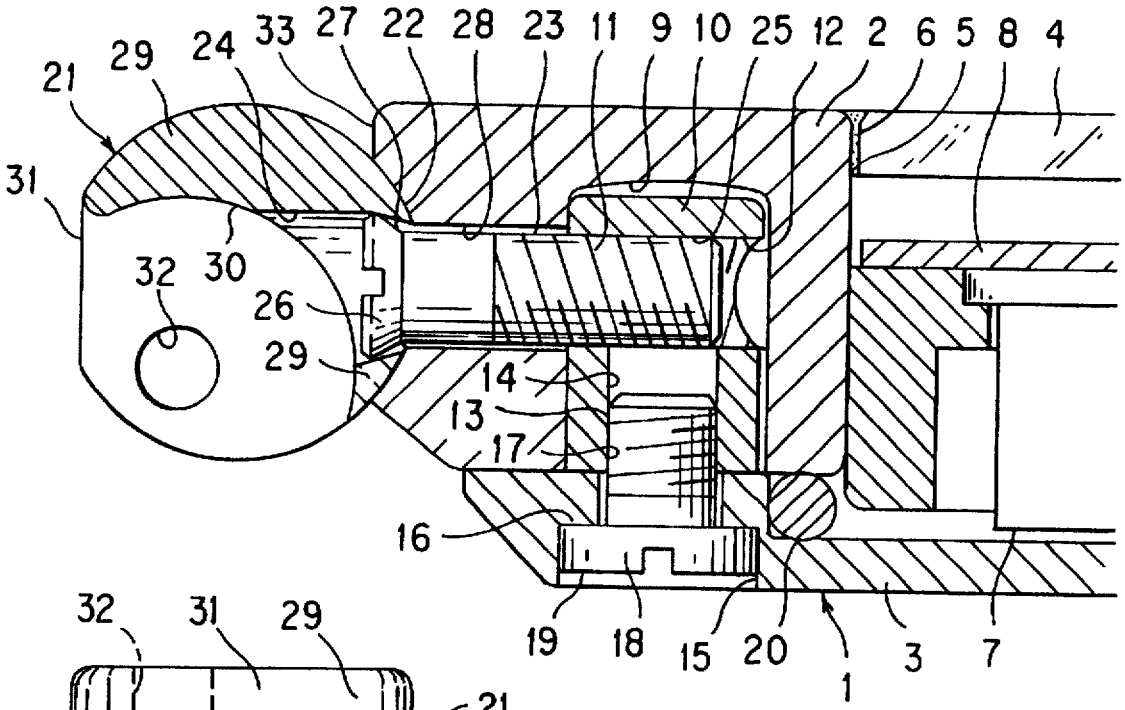
Figure 2:
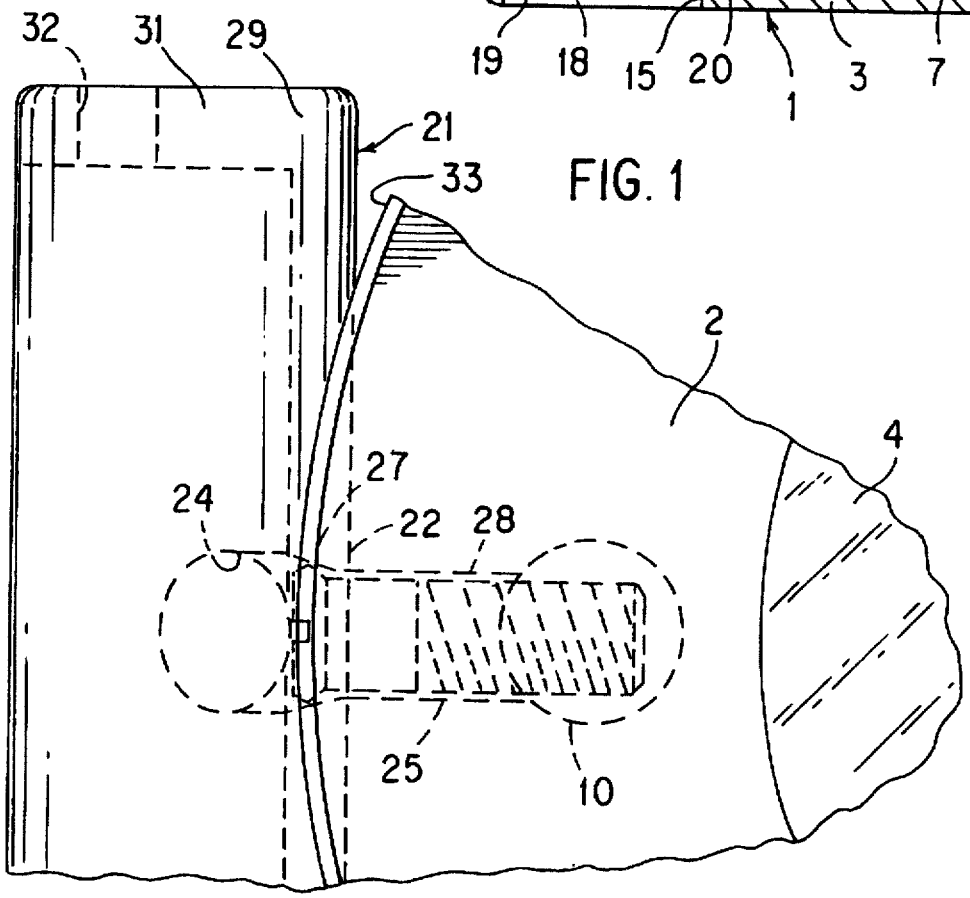

An example embodiment of the invention and its application will be explained more closely in the following with reference to the accompanying drawing. Shown are:

FIG. 1 a partial section through the watchcase along the *6h–12h* axis;

FIG. 2 a partial top view of the watchcase according to FIG. 1.

Shown in FIG. 1 is a partial section through the watchcase along the *6h–12h* axis. The watchcase 1 comprises a middle 2 and a back cover 3 detachably connected thereto. A watch crystal 4 at its outer edge 5 is cemented together with the inner wall 6 of the middle 2. Inserted in the watchcase 1 is a movement 7 and a dial 8. Two vertical, non-continuous, cylindrical bores 9 are provided in the middle in the *6h–12h* axis of the watchcase 1, which bores are open in the direction of the back cover 3. Inserted into the bores 9 is one metal cylinder 10 each. The cylinders 10 have a horizontal bore 12 provided with a threading 11 as well as a vertical bore 14 provided with a threading 13. If the case is made of hard metal, ceramic, natural stone or hard synthetic material, no threading can be provided therein. Inserted therefore in the vertical cylindrical bore 9 is a metal cylinder 10 having corresponding bores provided with threading. Two band connections 21 of round cross-section abut on two horizontal or vertical ground areas 22 at *6h* and *12h* on the middle 2 of the watchcase. The band connections are thereby recessed somewhat. The ground areas prevent the turning of the band connections. One horizontal retention screw 23 each is inserted in a bore 24 in the band connection and into a horizontal bore 28 in the middle 2, and is screwed with its threading 25 into the threading 11 of the horizontal bore 12 in the cylinder 10. The screw head 26 for fastening the screw 23 is contiguous to the conical end 27 of the bore 24 in the band connection 21. The two horizontal retention screws 23 are loaded essentially only when pulled. By means of the described configuration the band connection can be fastened to the side 33 of the middle of the watchcase without this band connection being able to turn. Furthermore it has no play. The band connection 21 has a solid part 29 with a milled out part 30. By means of this milled out part 30 two lateral plates 31 are formed, which are provided with a bore 32 for fastening the wristlet . The band connections 21 are placed against the ground areas 22, and then the screws 23 are led through the bores 24 in the band connections, and screwed into the threading 11 in the horizontal bores 12 in the cylinders 10. Two vertical bores 15 with a shoulder 16 are inserted into the *6h–12h* axis of the back cover 3 of the watchcase. Screwed through the vertical bores 15, into the vertical bore 14 in the cylinder 10 is one fastening screw 18 each, provided with a threading 17, for the back cover. The screw head 19 abuts thereby the shoulder 16. The back cover 3 is sealed off with respect to the middle 2 by means of a sealing ring 20. The vertical screws 18 do not penetrate the horizontal screws 23.

In another embodiment, not shown, an additional bore is provided in the upper part of the cylinder, into which bore a screw, for example for fastening the crystal, is screwed in.

Shown in FIG. 2 is a partial top view of the watchcase according to FIG. 1.

I claim:

1. A watchcase (1) with a middle (2), a back cover (3) and a crystal (4) characterized by two metal cylinders (10) inserted in bores (9) in the middle with at least one horizontal and vertical bore (12, 14) each, provided with a threading (11, 13), for receiving horizontal and vertical fastening screws (18, 23), the horizontal fastening screws (23) being led in horizontal bores (28) in the middle (2), and serving to fasten a band connection (21) to the watchcase (1), and the screw heads (26) of the horizontal fastening screws abutting the band connection (21) on the inside, and means (22) for rotation-tight holding of the band connection.

2. The watchcase according to claim 1, wherein a vertical bore (14) provided with a threading (13) is provided below in the metal cylinder (10) for fastening the back cover (3) of the watchcase (1) to the middle (2).

3. The watchcase according to claim 1, wherein a vertical bore provided with a threading is provided above in the metal cylinder for fastening the watch crystal.

4. The watchcase according to claim 1, wherein a vertical bore (14) provided with a threading (17) is provided below in the metal cylinder (10) for fastening the back cover (3) of the watchcase (1) to the middle and a vertical bore provided with a threading is provided above in the retaining body for fastening the watch crystal.

5. The watchcase according to claim 1, wherein the means are two horizontal or vertical ground areas (22) in the lateral area (33) of the watchcase (1) serving as the support for the band connection (21).

6. The watchcase according to claim 1, wherein the bores (9) in the middle (2) are disposed vertically.

* * * * *